United States Patent [19]

Hanamoto et al.

[11] 4,394,088

[45] Jul. 19, 1983

[54] COPYING MACHINE

[75] Inventors: Hiroyuki Hanamoto; Yoshihiro Horie, both of Toyokawa, Japan

[73] Assignee: Minolta Camera Kabushiki Kaisha, Higashi, Japan

[21] Appl. No.: 360,426

[22] Filed: Mar. 22, 1982

[30] Foreign Application Priority Data

Mar. 27, 1981 [JP] Japan ..... 56-45811

[51] Int. Cl.[3] ..... G03G 15/00

[52] U.S. Cl. ..... 355/14 R; 271/258

[58] Field of Search ..... 355/14 R, 14 C, 14 SH, 355/3 SH; 271/258, 259

[56] References Cited

U.S. PATENT DOCUMENTS

| | | | |
|---|---|---|---|
| 3,734,604 | 5/1973 | Szostak et al. | 355/14 R |
| 3,806,242 | 4/1974 | Reehil | 355/14 R |
| 4,054,380 | 10/1977 | Donohue et al. | 355/14 R |
| 4,139,300 | 2/1979 | Katayama et al. | 355/14 R |

*Primary Examiner*—R. L. Moses

*Attorney, Agent, or Firm*—Jackson, Jones & Price

[57] ABSTRACT

An improved copying machine is provided to eliminate problems associated with an erroneous indication of paper misfeed. Control means is provided for rendering a jam detection circuit inoperative when it is determined the copy paper is absent in the storage tray after the start of the copying cycle and before the introduction of the copy paper into the copying machine.

10 Claims, 6 Drawing Figures

COPYING MACHINE

BACKGROUND OF THE INVENTION

1. Field of the Invention

The present invention relates to a copying machine having at least one cassette removably inserted therein for accommodating copy sheets, and more particularly, to the control of such a copying machine.

2. Description of the Prior Art

Generally with copying machines, such as electrophotographic copying machines, which are equipped with an automatic paper feeder, sequential control for paper feeding and various other operations is executed when the machine is initiated into a copying operation (i.e., when the print switch is turned on). At this time, the advance of the copy paper fed out is checked by the use of various switching devices for detecting the presence or absence of the copy paper in the transport path of the paper. Generally, a timer is brought into operation to time the transport time of the copy paper to detect a jam when the copy paper has not reached or completely passed by a switch device within a predetermined period of time set on the timer. The jam detecting function is also performed under the sequential control.

On the other hand, copying machines provided with an automatic paper feeder also have paper absence detecting means for determining whether the copy paper stored in a paper accommodating portion has been exhausted in order to prevent the start of a copying operation. The copy machine is controlled to initiate its copying operation in accordance with a start signal for starting the copying operation when the paper accommodating portion is not empty.

The copying machines having a cassette removably inserted in the main body for accommodating sheet paper include those which require some initial period of time in which to start feeding the sheet paper after a copying operation start signal has been emitted. These copying machines generally have the function of checking the stock of paper upon the emission of a start signal, but the paper stock is not subsequently checked at the moment when a sheet of paper is to be actually fed out. Consequently, if the user recognizes, immediately after depressing the print switch, that the sheet paper of a desired size or kind is not installed for use and withdraws the paper accommodating cassette, the machine nevertheless starts its copying operation, executing sequential control including jam detection because the presence of the paper has been detected upon the initial depression of the print switch. It is therefore likely that the jam detecting means will function to stop the copying operation and display a jam signal, since no paper was detected within a specified period of time. In the event of such a situation, the user must follow the cumbersome procedure of opening the door of the copying machine, turning on a resetting switch to restore the jam detecting means, turning on the power supply switch, etc., although no paper jam has actually occurred.

Our copending U.S. application Ser. No. 254,275 filed on Apr. 15, 1981, discloses a copying apparatus including a manual paper feeding mechanism and a jam detecting mechanism which is so controlled to render the jam detecting mechanism in an inoperative condition when the paper is withdrawn after the manual paper feeding has commenced. U.S. Pat. No. 4,280,763 is cited of general interest to disclose a sequential control circuit for a copying machine.

The prior art is still seeking to optimize copier operation for the users.

SUMMARY OF THE INVENTION

A main object of the present invention is to provide a copying machine which is free of unnecessary paper feeding complications and convenient to use.

Another object of the invention is to provide a copying machine which is controlled so that a predetermined jam detecting function incorporated therein can be cancelled when no sheet of paper is transported from the storage paper accommodating position.

Still another object of the invention is to provide a copying machine which has at least one cassette insertable into and removable from its main body for accommodating sheet paper and requires an initial period of time before starting to feed the paper after a copy start signal has been emitted and which is further controlled to cancel any jam detecting function thereof when the cassette is withdrawn within a specified period of time after the start of a copying operation.

These and other objects of the invention can be fulfilled in the environment of a copying machine which has at least one cassette containing a stack of sheet paper insertable into and removable from a storage paper accommodating portion adjacent the main copier body, feed means for feeding out the sheet paper from the cassette toward a sheet transporting path, and jam detecting means for emitting a jam signal when the sheet paper is not transported to a predetermined position. In general, the copying machine requires some period of time before starting to feed the sheet paper after an emission of a copy start signal, the copying machine being further characterized by means for detecting the presence or absence of the sheet paper in the paper accommodating portion and control means for rendering a jam detecting operation of the jam detecting means inoperative when the sheet paper is determined to be absent in the paper accommodating portion during a specified period of time after the emission of the copy start signal.

More specifically, the objects of the invention can be fulfilled by determining the specified period of time during a period of time between the emission of the copy start signal and starting of the feed of the sheet paper, and the paper detecting means checks the presence or absence of the sheet paper in a storage tray approximately at the same time as the start of the feeding of the sheet paper into the copier machine.

The jam detecting means can include at least one jam timer which is set at a predetermined time to emit a jam signal when the sheet paper has not been transported to a predetermined position at a time within the expiration of said jam detecting timer. The control means can render the jam detecting means inoperative by only permitting the setting of the jam timer on the condition of monitoring the presence of sheet paper upon checking the paper detecting means.

More specifically, the control means can include a timer which is set at least at the timing of the emission of a copy start signal and which determines, by expiration of the timer, the starting of the feed of the sheet paper and the subsequent detection of the presence or absence of the sheet paper by the paper detecting means.

The copying machine of the present invention is preferably constructed to be applicable for a transfer type electrophotographic copying machine which comprises a photoconductor, means for forming an image on the surface of the photoconductor and means for transferring said image to the sheet paper.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

The following specification, taken in conjunction with the drawings, sets forth the preferred embodiment of the present invention in such a manner that any person skilled in the copier field can use the invention. The embodiment of the invention disclosed herein is the best mode contemplated by the inventors for carrying out their invention in a commercial environment, although it should be undersood that various modifications can be accomplished within the parameters of the present invention.

This invention will hereinafter be described in detail, reference being had to the accompanying drawings.

Figure 1:
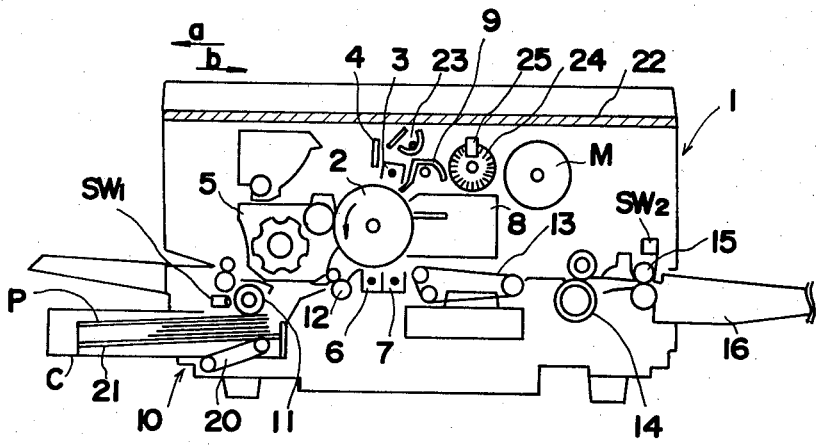
FIG. 1 is a cross-sectional view schematically showing a transfer type of electrophotographic copying machine.

FIG. 1 is a cross-sectional diagram, schematically showing a copying machine 1 having incorporated therein the control system of this invention. The construction and copying operation of the machine 1 will now be described generally with reference to the drawing. A photoconductive drum 2, disposed approximately in the center of the main body of the copying machine 1, is rotatable counterclockwise in FIG. 1. Arranged sequentially around the drum 2 are a sensitizing charger 3, an optical system 4, comprising a bundle of optical filters having graded refractive indexes, etc., a developing unit 5, a transfer charger 6, a charge erasing AC charger 7, a cleaner 8, and an eraser lamp 9, etc. With the rotation of the drum 2, the photosensitive surface of the drum is subject to sensitization, exposure and development successively to form a toner image, which is then transferred onto a sheet of paper P which is supplied in timed relation to the rotation of the drum to make a copy of the developed image.

Sheets of paper P are stacked in a cassette C in a paper storage accommodating portion 10. A lift member 20 pushes up an inner plate 21 of the cassette C, pressing the paper P against a feed roller 11 which, when rotated, feeds out a sheet of paper. The paper P, pushed up in the storage accommodating portion 10, is detected by a paper detecting switch SW1. When the cassette C is emptied of the paper P, the detecting switch SW1 opens to disable the copying machine from a copying operation. The sheet of paper P being transported towards the interior of the machine is temporarily halted by a timing roller 12, which is thereafter driven in response to a suitable timing signal to send the sheet further forward in timed relation to a toner image on the drum 2. The transfer charger 6 transfers the toner image to the sheet which is placed over the image on the drum 2 at the transfer station. The sheet P is separated from the drum 2 at the location of the erasing charger 7, carried on a conveyor belt 13 to a fixing unit 14 and then delivered onto a tray 16 by discharge rollers 15. The sheet P to be discharged is detected by a jam detecting switch SW2, which cooperates with a timer, to be described later, to check the transport of the sheet P. When the sheet P is not transported within a predetermined period of time set on the timer, a judgment of jam is given and displayed.

The original document (not shown) is placed on a document carriage 22, of glass or like transparent material, which is supported on the top of the machine main body and reciprocatingly movable. The carriage 22 is moved in a scan direction a while being illuminated by an exposure lamp 23 from below, causing the optical system 4 to project the image of the original on the surface of the drum 2. When the copying machine 1 is initiated into a copying operation (by activating the print switch), the document carriage 22, halted in its central position as illustrated, first preliminarily moves in the direction of arrow b shown to a scan starting position and thereafter moves in the direction of arrow a for scanning. With the scanning movement, the feeding of the paper P is started. Accordingly, the copying machine 1 requires some time delay for starting the feed of paper after the initiation of the copying operation.

For controlling the copying operation described above, the copying machine 1 has a microcomputer 100, to be described later, whereby the state of the paper detecting switch SW1 and that of the jam detecting switch SW2 are detected with suitable timings to thereby check the paper cassette C for emptiness and also detect any jam in the path of transport of the paper P. The copying machine 1 further has, in its interior, a pulse generating disk 24 which rotates in synchronism with a drive motor M. The rotation of the disk 24 produces pulse signals by the use of slits formed in the disk 24 along its periphery and a photocoupler 25 comprising a light-emitting element and a photocell. The pulse signals are fed to the microcomputer 100 to time the copying operation of the machine 1 with a control mode afforded by the microcomputer 100. The timed relationship established between the microcomputer 100 and the copying machine 1 by the pulse signal from the disk 24 is disclosed in detail in U.S. Pat. No. 4,280,763, which is incorporated herein by reference to supplement the present disclosure.

Figure 2:
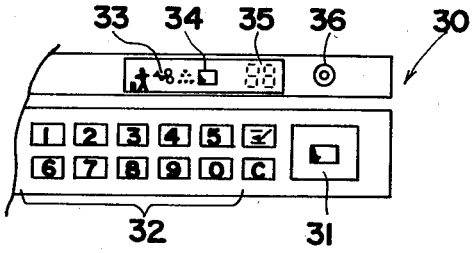
FIG. 2 is a plan view, partly broken away, showing an operation panel for the copying machine.

FIG. 2 shows an operation panel 30 on the copying machine 1. The panel 30 has a print switch 31 for starting the copying operation, that is, for emitting the copy start signal, a key arrangement 32 for setting the number of copies to be made, a jam display 33, an empty display 34 which goes on when the cassette C is emptied of the paper P or when the cassette C is not inserted in place, a copy number display 35 for showing the set copy number which progressively decreases by subtraction for every copying cycle, and a power supply display 36.

Figure 3:
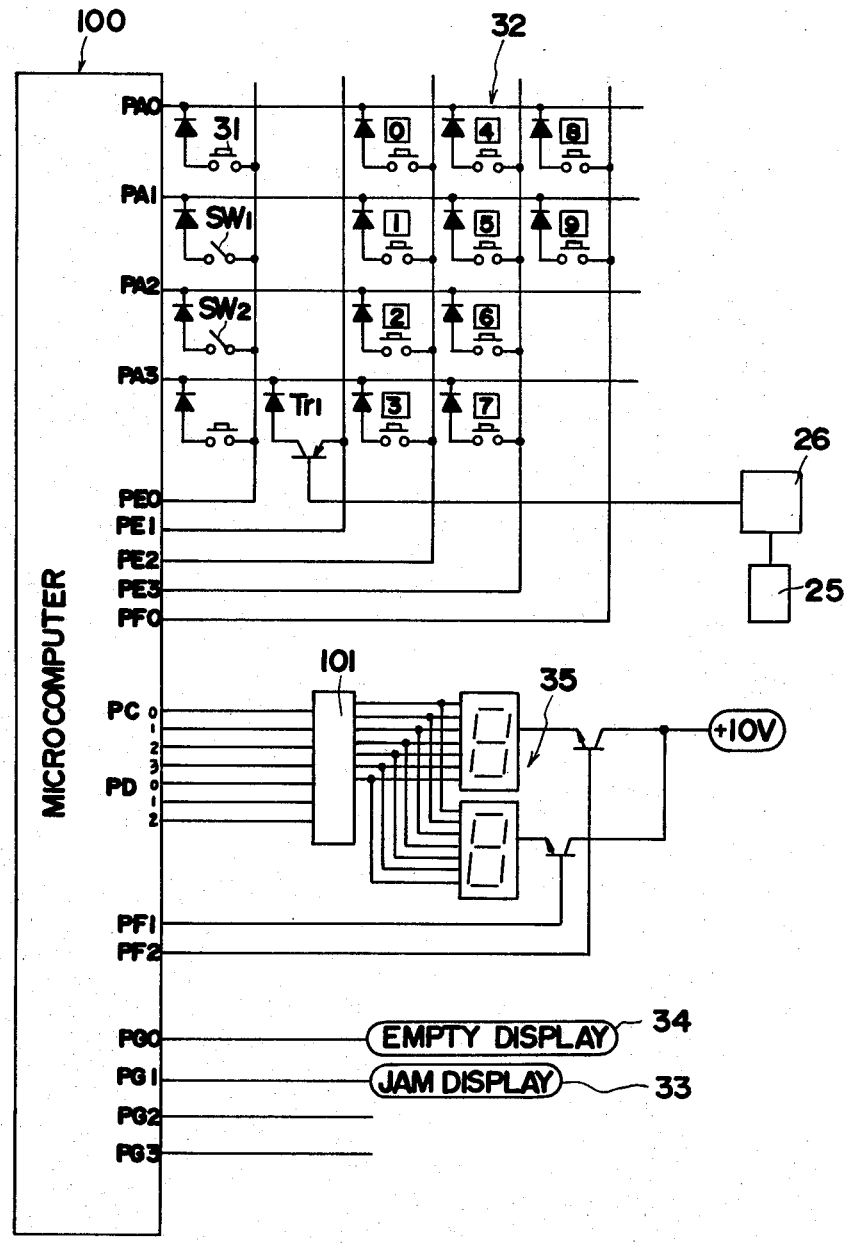
FIG. 3 is a circuit diagram showing a microcomputer control system as related to input switches, displays, etc.

The microcomputer 100, of a type known in the prior art, is associated with these displays, input switches, etc. as shown in FIG. 3, and is adapted to detect empties, paper jams, etc, and sequentially controls the copying operation. With reference to the time chart of FIG. 4 and the flow charts of FIGS. 5(*a*) and (*b*), the control performed by the microcomputer 100 will be described below chiefly in respect to a mode of control according to the present invention.

With reference to FIG. 3, the microcomputer 100 has an output port PE0 which is connected to input ports PA0, PA1 and PA2 via the print switch 31, paper detecting switch SW1 and jam detecting switch SW2, respectively. An output port PE1 is connected to an input port PA3 by way of a transistor Tr1 which is turned on or off by a suitable pulse signal from a pulse generator 26 which receives signals from the above-mentioned photocoupler 25. Output ports PE2, PE3, PF0 are connected to the input ports PA0 to PA3 via the number key arrangement 32. Output ports PC0 to PC3 and PD0 to PD2 for giving signals for controlling the seven-segment display portions of the number display 35 are connected to a decoder 101. Output ports PF1, PF2 each control the timing with which the seven-segment display portion for the corresponding digit position is turned on. The empty display 34 and the jam display 33 are turned on under the control of signals from output ports PG0 and PG1, respectively.

As already stated, the presence or absence of the paper P in the cassette C is detected in accordance with the state of the paper detecting switch SWL. When the cassette C is emptied of the paper P with its inner plate 21 in its raised position, the actuator of the switch SW1 drops into a suitable cutout formed in the plate 21 to turn off the switch SW1, whereupon the input to the input port PA1 of the microcomputer 100 falls to a "L" (low) level. Thus, an empty condition is detected. The same judgment is made also when the cassette C is not placed in an operative position. Alternatively a light-emitting element and a photocell may be provided above and below the cassette C, with a light passing hole formed in the inner plate 21 as well as in the frame of the cassette C, to detect the absence of the paper P when light impinges on the photocell.

Figure 4:
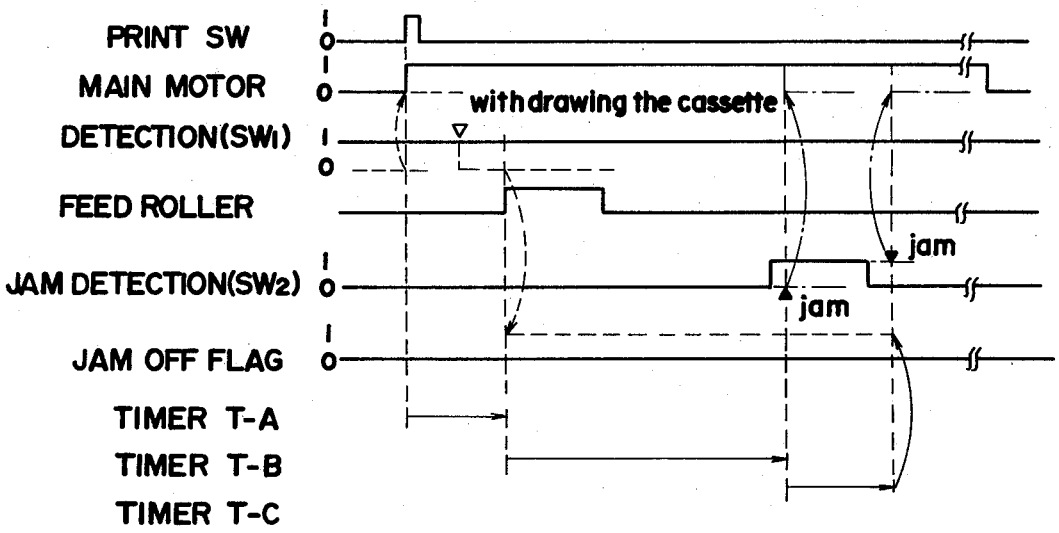
FIG. 4 is a time chart for illustrating the operation of the control system of the invention.

The mode of control according to the present invention will be described below with reference to the flow charts of FIGS. 5(*a*) and (*b*) and also the timing chart of FIG. 4 showing the mutual operational relationship of the main components referred to in the flow chart.

Figure 5A:
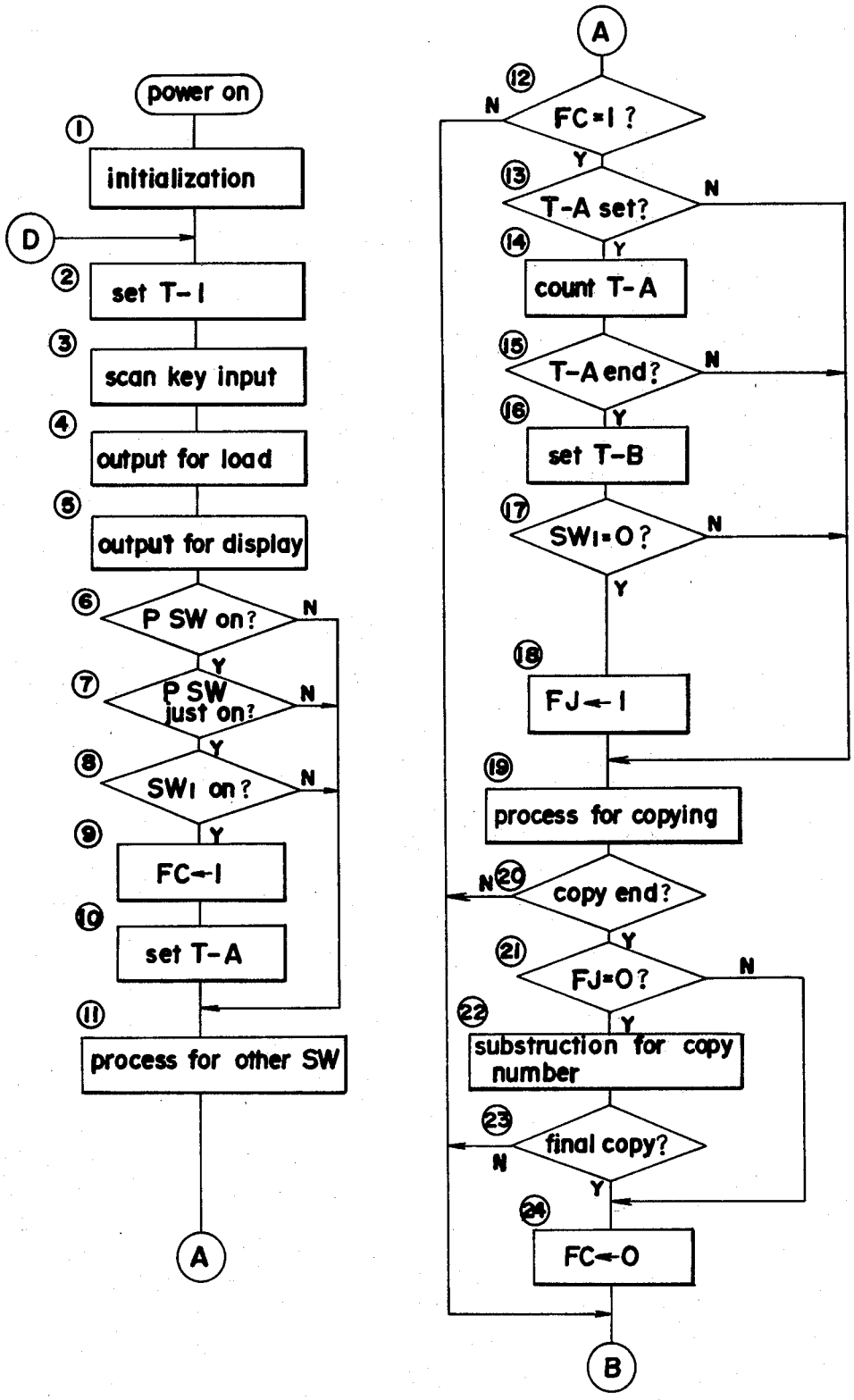
FIGS. 5(*a*) and (*b*) are flow charts showing, for illustrative purposes, the processing steps for executing control by the microcomputer.
Figure 5B:
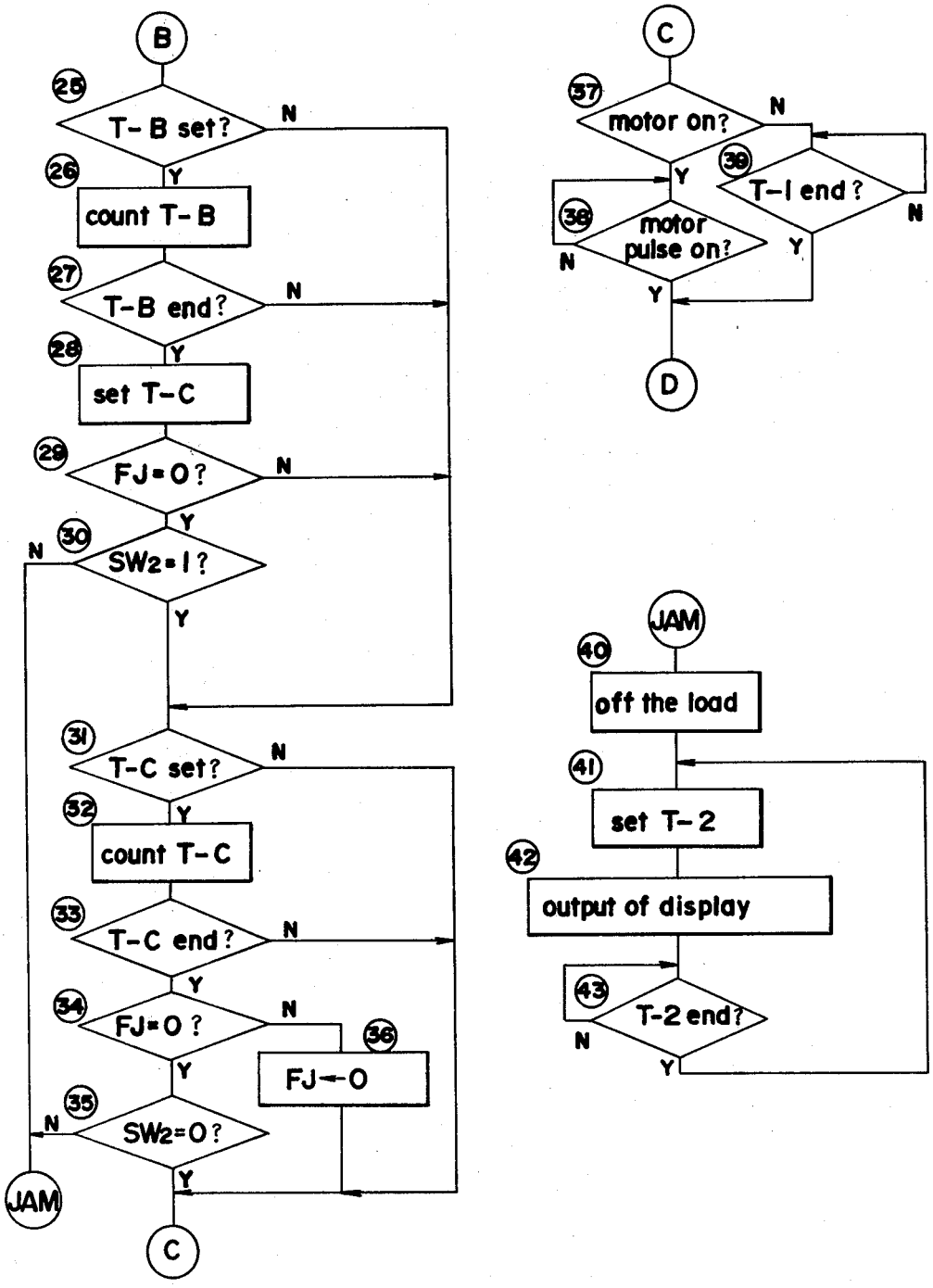

With reference to FIG. 5(*a*), step 1 is performed for initialization when the power supply is turned on for the copying machine 1. The initialization is performed automatically according to predetermined data stored in a memory location (not shown) of the microcomputer 100 to set the value to be shown on the copy number display 35 to "1", the amount of exposure to the standard level, etc. By the initialization, the predetermined one of paper storage accommodating portions may be selected when a number of such portions are provided, and the standard magnification of reproduction (e.g., life size) may be set if the magnification is selectively variable. The process of step 1 further includes the normal clearing of a RAM memory, changing of flags to "0", resetting of timers, etc.

In step 2, an internal timer T-1 within the microcomputer 100 is set for prescribing the time taken for one routine of process to be performed by the computer 100. Although the function of the internal timer T-1 will be described later, U.S. Pat. No. 4,280,763 already mentioned discloses in detail the relation between the internal timer and the pulse signal from the pulse generating disk 24.

The inputs of keys, such as the number key arrangement 32, are scanned or confirmed in step 3. Outputs are given to all the loads in step 4, and outputs for displays are delivered in step 5.

Step 6 checks the state of the print switch 31. Unless it is on, step 11 follows. If it is on, step 7 checks whether or not the print switch 31 is depressed in the routine being performed. When the switch is found to be on for the first time in the routine concerned, step 8 checks the state of the paper detecting switch SW1. If SW1=1, i.e., if the paper 1 is present, step 9 changes a copy flag FC to "1" and initiates a copying operation including the rotation of the photoconductive drum 2. A timer T-A for determining paper feeding timing is set in step 10. Other switch inputs are processed in step 11.

When the copy flag FC is found to be "1" in step 12, steps 13, 14 allow the timer T-A to count up, and step 15 checks the timer T-A for the lapse of time set thereon. The timer T-A and the timers T-B, T-C to be described below are digital timers which are so programmed as to count up for every routine of the process by the microcomputer 100. The counts are stored in the memory concerned as numerical data.

When the completion of operation of the timer T-A is detected in step 15, a timer T-B for detecting the jam of the leading end of paper P is set in step 16. Step 17 checks the state of the paper detecting switch SW1. If SW1=0, a flag FJ for cancelling the jam detecting function to be described later is changed to "1" in step 18, which is followed by step 19 which executes a process for the copying operation including driving of the feed roller 11. If SW1=1, step 19 directly follows with the flag FJ remaining "0". Step 19 performs an operation within the computer for controlling the copying operation.

The completion of the copying operation is checked in step 20. When the flag FJ is found to be "0" in step 21, i.e., only when the paper P has been transported, step 22 performs substraction for the copy number on the display 35.

Step 23 checks the result of the subtraction, i.e., whether or not the set number of copies have been completed. If the final copy has been made, step 24 changes the copy flag FC to "0".

FIG. 5(*b*) shows a process for detecting the jam of the leading end of the paper P by steps 25 to 30. The timer T-B is set on completion of the operation of the timer T-A, i.e., simultaneously with the start of feeding of the paper. The time set on the timer T-B elapses after the leading end of the sheet of paper P fed out has reached the jam detecting switch SW2. Accordingly, a judgment of jam is given when the jam detecting switch SW2 is found to be "0" by step 30 upon the lapse of time set on the timer T-B as detected by step 27. The step 30 of jam detection is not performed when the aforementioned flag FJ is "1".

Upon the lapse of the time set on the timer T-B, a timer T-C for detecting jamming of the rear end of the paper P is set in step 28 to a period of time which elapses after the rear end of the paper P being transported has passed by the jam detecting switch SW2. Steps 31 to 36 are performed for detecting the rear end jam. In this case, a judgment of jam is given (step 35) if the jam detecting switch SW2 is "1" upon the lapse of the time set on the timer T-C (step 33). If the flag FJ is "1" in this case, step 35 is not performed but step 36 follows in which the flag FJ is changed to "0".

While the internal timer T-1 and the photocoupler 25 are provided for the process by the microcomputer 100, steps 37, 38 and 39 show the relationship between the timer T-1 and the pulse signal (motor pulse) from the photocoupler 25. To time the process by the computer 100 with the drive of the motor M during the rotation of the motor M, a motor pulse, when detected, initiates a processing routine (step 38). While the motor M is out of operation, the processing routine is initiated upon the lapse of the time set on the internal timer T-1 (step 39). The internal timer T-1 is provided to avoid the problem that would result when the timer for one processing routine by the microcomputer 100 is altered by the process. The timer is set to a period of time slightly longer than the maximum processing time for one routine. The interval of the motor pulses is made approximately equal to the time set on the internal timer.

Steps 40 to 43 are performed when a jam is detected. The load inputs to the motor, chargers, lamp, heater, etc., are turned off in step 40 to interrupt the copying operation. An internal timer T-2 for prescribing the length of the routine for handling the jam is set in step 41. Step 42 controls the display output for turning on the lamp of the jam display 33. Upon the lapse of the time set on the internal timer T-2 in step 43, step 41 follows again. These steps are repeated until unillustrated jam resetting means is operated.

As will be apparent from the above description of the present invention, the copying operation is initiated only when sheet paper P is present in the paper storage accommodating portion 10. Further, after the initiation of the copying operation, the presence of the paper P is checked again upon the lapse of the time set on the timer T-A. In the event of no paper, the jam detecting function is not performed, nor is counting performed for the copy number setting. Accordingly, even if the cassette is withdrawn after the start of copying operation, the machine will not involve a condition wherein a jam would be detected or the number of copies on display would change although no sheet of paper has been transported actually. Thus, the normal procedure of rectifying a jam, by resetting and turning on of the power supply, etc., is eliminated.

In the foregoing embodiment, the timing with which the presence of the paper is rechecked after the start of a copying operation is determined utilizing the timer T-A for determining the timing for driving the feed roller 11. However, a separate checking timer may be provided for this purpose. Furthermore, the paper may be rechecked before or after the start of the feed roller insofar as the subsequent jam detecting operation is not thereby affected.

The jam detecting system of the foregoing embodiment has been described for illustrative purposes only. The location of detection, the specific circuit construction for detection, etc. can be determined suitably in connection with the construction of the particular style of copying machine itself and with the control system.

As an example of a copying machine in which there is some time delay before the start of feeding of the paper after the initiation of copying operation, the above embodiment is of such type that a preliminary movement of the document carriage 22 takes place first upon the start of a copying operation, followed by its scanning movement and the feeding of paper. The invention is not limited to this embodiment but is also applicable to copying machines in which an optical system performs a scanning movement with the start of a copy operation, followed by the emission of a signal for driving the feed roller during the movement.

Although the foregoing embodiment is so adapted that the counting operation for the copy number setting and the jam detecting operation are merely cancelled when the absence of paper is detected after the start of copying operation, the mode of control may further be so modified as to perform the subsequent copying operation a short period of time thereafter, with reinsertion of a paper cassette, or by causing the optical system to stop its scanning movement and return, and turning off the exposure lamp, chargers, etc.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed:

1. A copying machine which includes at least one cassette containing a stack of sheet paper insertable into and removable from a paper accommodating portion of its main body, feed means for feeding out the sheet paper from the cassette toward a sheet transporting path and jam detecting means for emitting a jam signal when the sheet paper is not transported to a predetermined position within a predetermined time, and which requires some period of time before starting to feed the sheet paper after an emission of a copy start signal, the copying machine comprises:

means for detecting the presence or absence of the sheet paper in the paper accommodating portion; and control means for rendering a jam detecting operation of the jam detecting means inoperative when the sheet paper is determined to be absent in the paper accommodating portion during a specified period of time after the emission of the copy start signal whereby the jam detecting operation is rendered inoperative when the cassette is withdrawn from the paper accommodating portion within said specified period of time.

2. A copying machine as claimed in claim 1, wherein said specified period of time is a period of time between the emission of the copy start signal and starting of the feed of the sheet paper.

3. A copying machine as claimed in claim 1, wherein said paper detecting means checks the presence or absence of the sheet paper approximately with the same timing as the starting of the feed of the sheet paper.

4. A copying machine as claimed in claims 1, 2, or 3, wherein said jam detecting means includes at least one jam timer which is set at a predetermined timing and which emits the jam signal when the sheet paper is not transported to the predetermined position at a time expiration of said jam time, and said control means permits the setting of said jam timer upon the condition of a presence of the sheet paper by checking said paper detecting means.

5. A copying machine as claimed in claim 3 is a transfer type of electrophotographic copying machine which comprises a photoconductor, means for forming an image on the surface of said photoconductor and means for transferring said image to the sheet paper.

6. In a transfer type of copying machine which includes a photoconductor, means for forming an image on the surface of the photoconductor, a paper accommodating portion for holding copying paper, means for forming a copy paper transportation path, feed means for removing the copy paper from the accommodating portion and directing it towards the copy paper transporting path, means provided in the copy paper transporting path close to the photoconductor and jam detecting means for emitting a jam signal when the copy paper is not transported to a predetermined position within a predetermined time, the copying machine requiring a period of time before starting to feed the copy paper after receipt of a copy start signal, the improvement comprising:

paper detecting means provided in the paper accommodating portion for detecting the presence or absence of the copy paper; and control means for rendering a jam detecting operation of the jam detecting means inoperative when the copy paper is determined to be absent in the paper accommodating portion within a predetermined time after the emission of the copy start signal, whereby the jam detecting operation is rendered inoperative when copy paper is withdrawn from the paper accomodating portion in a manner other than along the copy paper transportation path in a within said predetermined time.

7. A copying machine as claimed in claim 6, wherein said predetermined time is approximately the same time as required for the normal time period to start the movement of the copy paper into the copy machine in a reproduction cycle.

8. A copying machine as claimed in claim 7, wherein said jam detecting means includes at least one jam timer which is set at a second predetermined time and emits a jam signal when the copy paper is not transferred to a predetermined position at the time expiration of said jam timer, and said control means renders said jam detecting means inoperative by only permitting the setting of said jam timer on a condition of the operative presence of the copy paper by checking said paper detecting means.

9. A copying machine as claimed in claim 7 or claim 8, wherein said control means includes a timer which is set at a timing of the emission of the copy start signal and which determines by the expiration of the timer, the starting of the feed of the copy paper and the detection of the presence or absence of the copy paper by said paper detecting means.

10. In an improved copying machine having means for recording an image, means for developing an image, means for storing copy paper, a copy paper transportation system for translating copy paper to receive the developed image, to fix it to the copy paper and to position it for removal from the copy machine, means for moving copy paper from the storing means into the paper transportation system, means for determining the presence of copy paper in the storing means and providing a signal, means for determining the movement of the copy paper through the paper transportation system including a paper sensing monitor for providing a signal and a timing means initiated upon energization of a copying cycle to provide a first time period before introduction of copy paper into the paper transportation system, the improvement comprising:

a paper transport error detecting means responsive to the means for determining the movement of the copy paper and enabled by a signal representing a failure of copy paper to reach the paper sensing monitor within a predetermined time; and control means connected to the paper transport error detecting means and the means for determining the presence of the copy paper in the storing means for disabling the paper transport error detecting means when the means for determining the presence of copy paper renders a no paper signal after energization of a copy cycle and before expiration of the first period of time.

* * * * *

UNITED STATES PATENT AND TRADEMARK OFFICE

CERTIFICATE OF CORRECTION

PATENT NO. : 4,394,088

DATED : July 19, 1983

INVENTOR(S) : Hiroyuki Hanamoto

It is certified that error appears in the above-identified patent and that said Letters Patent are hereby corrected as shown below:

Column 9, line 12, after "photoconductor" add --for transferring said image to the copy paper--.

Signed and Sealed this

First Day of November 1983

[SEAL]

*Attest:*

GERALD J. MOSSINGHOFF

*Attesting Officer*

*Commissioner of Patents and Trademarks*